United States Patent [19]

Ruiz

[11] 4,070,882

[45] Jan. 31, 1978

[54] LOCK SHIELDING ASSEMBLY

[76] Inventor: Roberto Ruiz, 1360 Ocean Parkway, Brooklyn, N.Y. 11230

[21] Appl. No.: 724,967

[22] Filed: Sept. 20, 1976

[51] Int. Cl.[2] ..... E05B 17/14

[52] U.S. Cl. ..... 70/427; 70/455

[58] Field of Search ..... 70/6, 158–164, 70/166–169, 209, 404, 371, 232, 423–428, 451, 455

[56] References Cited

U.S. PATENT DOCUMENTS

| | | | |
|---|---|---|---|
| 1,917,973 | 7/1933 | Hughes | 70/427 |
| 2,883,849 | 4/1959 | Lorenzo | 70/427 |
| 3,563,069 | 2/1971 | Ferrer | 70/209 X |
| 3,714,804 | 2/1973 | French | 70/419 |
| 3,867,822 | 2/1975 | Morse | 70/164 |

*Primary Examiner*—Robert L. Wolfe
*Attorney, Agent, or Firm*—Friedman, Goodman & Teitelbaum

[57] ABSTRACT

A lock shielding assembly for preventing unauthorized access to a lock by providing a shield over the lock which can easily be removed by authorized individuals, while requiring an unauthorized person an extensive amount of time to open. The assembly includes a housing which can be superimposed over the front face of the lock. The housing includes a slot positioned between a front and rear wall and includes cooperating openings in the walls providing access to the key hole of the lock. A shield plate is slidably mounted in the slot for movement to and from a position covering the lock. A plurality of pins extend into the front wall, selectable ones of the pins extending through the front wall and into engagement with the shield plate to retain the shield plate in its position covering the lock. The location of the selected pins are known only to the authorized user who can easily remove them, while the unauthorized individual must remove all or most of the pins. A cover plate is removably superimposed and lockable on the housing to prevent access to the pins and provides a further measure of security.

14 Claims, 7 Drawing Figures

LOCK SHIELDING ASSEMBLY

BACKGROUND OF THE INVENTION

This invention relates to a lock shielding assembly and more particularly to an assembly for shielding the key receiving aperture of a door lock, or the like, so as to prevent the insertion of a key into the key hole of the lock by an unauthorized person.

With the increase in theft, there has resulted a trend towards providing security devices and auxiliary apparatus which can be attached to existing locks to increase the security of the lock mechanism. While conventional locking devices require a specific key to open them, most lock operating mechanisms such as pin tumbler locks can be picked by a skillful thief and have been shown to be ineffective in providing sufficient security. As a result, mechanisms have been provided to shield the lock from an unauthorized person so that he cannot reach the lock cylinder to pick the lock.

Many of these auxiliary apparatus attach to the door or other area supporting the conventional lock, and provides a cover over the conventional lock which is in turn secured to the door or to a separate housing. One such door attachment is shown and described in U.S. Pat. No. 2,883,849. This patent describes a lock shielding attachment which includes a support plate having guides through which a cover plate can slidably move. Forward projecting integral ears on both the support plate and the cover plate have registered apertures through which a padlock can be inserted to retain the cover plate in a closed position shielding access to the conventional lock.

Another such shielding mechanism is described in U.S. Pat. No. 3,714,804 which utilizes an armored cover plate and shutter mechanism, wherein the shutter plate can move between a blocking and unblocking position. The shutter plate is supported by a rotating gate and is retained in a closed position by means of an outwardly extending leg which includes an aperture aligned with a ring on the outer housing. Again a padlock is used to secure the plate to the housing.

These, and other similar apparatus although shielding the lock, can be ripped off and removed to provide access to the lock cylinder. For example, the padlock can be broken by force or its hasp can be cut. Additionally, the flat surfaces of the shielding apparatus permit them to be forced open by hammering or ripping off the entire apparatus.

It has been found that one of the best deterrents to theft is not so much the actual provision of an auxiliary apparatus to shield the lock, but the amount of time needed to break into or open the apparatus. For example, the most complex apparatus provides little deterrent if it can be removed by force in a short period of time. On the other hand, a more simplified apparatus provides a better measure of security if it requires a greater amount of time for a thief to force or break open.

SUMMARY OF THE INVENTION

Accordingly, it is an object of the present invention to provide a lock shielding assembly for preventing unauthorized access to a lock and which avoids the aforementioned problems of prior art devices.

A further object of the present invention is to provide a lock shielding assembly which can be easily removed in a short period of time by an authorized user, while requiring an unauthorized individual a great amount of time and effort to open.

Still a further object of the present invention is to provide a lock shielding assembly having a housing with angled or inclined sidewalls, which prevents banging off of the housing to obtain access to the lock.

Yet a further orject of the present invention is to provide a lock shielding assembly which includes a slidable shield plate which can prevent access to the lock, and a cover plate which prevents access to the shield plate.

A further object of the present invention is to provide a lock shielding assembly having a shield plate adapted to be coupled to a housing by means of pins, the position of the pins being selectively alterable by the authorized user to add a degree of security.

Yet a further object of the present invention is to provide a lock shielding assembly which provides a combined effect of security measures to prevent authorized access to a lock.

In accordance with the invention, there is provided a lock shielding assembly for preventing authorized access to a lock and including a housing which is adapted to be fixedly superimposed over the front face of the lock. The housing includes a rear wall and a front wall spaced therefrom for defining a slot therebetween. Cooperating openings in the walls provide access to the keyway of the lock. A shield plate is slidably mounted in the slot for movement between a first position covering the lock to prevent access thereto through the wall openings, and a second position displaced from the first position to permit access to the lock keyway through the openings. A plurality of pins extend into the front wall. Selectable ones of the pins extending through the front wall, also extend into engagement with the shield plate to thereby retain the shield plate in its first covering position.

The pins are positioned in an array with the heads of the pins being substantially identical. Some of the pins contain longer shank portions which can thereby engage the shield plate. The location of the longer shanked pins can be selected by the authorized user. However, externally, all of the pins appear substantially identical. As a result, while the authorized user can easily remove the shield plate by only removing the few longer pins whose location he knows, an unauthorized user must remove all or most of the pins in order to remove the shield plate. The removal of all the pins requires a great amount of time which will deter a thief from picking the lock.

To further add a measure of security, a cover means is removably superimposed on the housing to prevent access to the pins. Additionally, the sidewalls interconnecting the front and rear walls are angled to prevent banging off of the entire housing. The cooperating openings in the walls include a first clearance hole in the front wall for both the lock cylinder and the enlarged lock face plate, and an aligned second clearance hole in the rear wall for only the lock cylinder, whereby the lock face plate is positioned in the slot in abutment against the rear wall with the lock cylinder passing through the rear wall of the housing. Therefore, should the housing be banged off, it would break the entire cylinder so that the lock would remain locked and could no longer be picked by conventional methods.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DESCRIPTION OF THE PREFERRED EMBODIMENT

Figure 1:
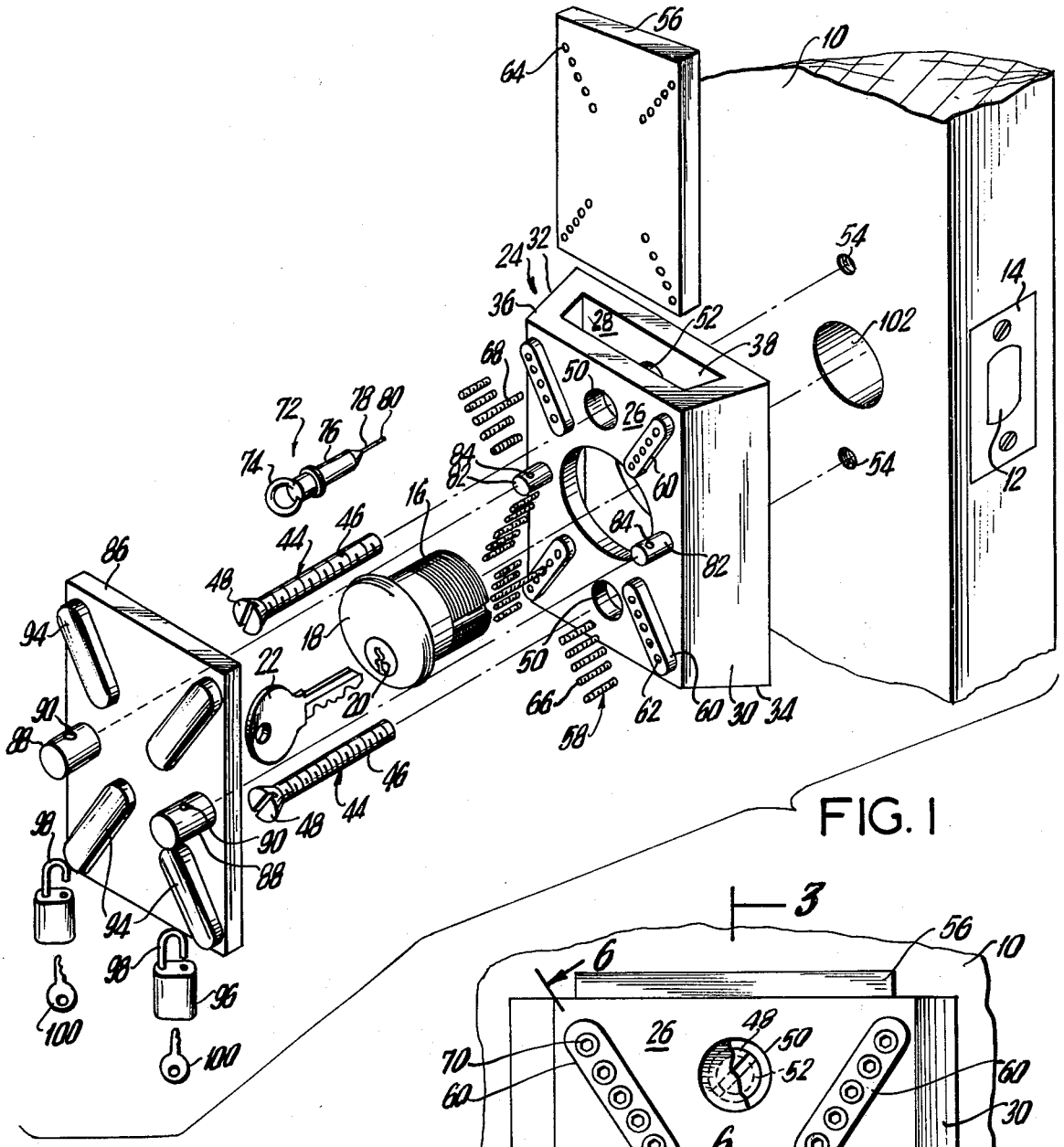
FIG. 1 is an exploded perspective view of the lock shielding assembly of the present invention in association with the lock cylinder.

In the form of the invention shown in the figures, the device is described as mounted on a door 10 provided with a conventional latch 12 and a latch plate 14 operated by a lock cylinder 16 of a conventional type, such as a pin tumbler lock. A face plate 18 on the lock cylinder includes a conventional rotary plug having a key hole 20 in which a key 22 can be inserted to align the tumblers and thereby rotate the plug to manipulate the latch 12 to open and close the door. It is to be noted, that the face plate 18 is larger than the remaining body of the lock cylinder 16.

The lock shielding assembly of the present invention includes a housing, shown generally at 24, having a front wall 26 and a rear wall 28 interconnected by angularly formed sidewalls 30 and 32 and an angularly formed bottom wall 34. The top wall 36 includes a slot 38 therein which extends between the front and rear walls and terminates at the bottom wall 34 Clearance holes 40, 42 are provided through the front and rear walls in which the lock can be inserted. The clearance hole 40 in the front wall permits the face plate 18 as well as the cylinder 16 to pass therethrough. The aligned clearance hole 42 in the rear wall only permits the lock cylinder 16 to pass therethrough, but stops the face plate 18. As a result, when assembled, a portion of the lock cylinder will extend through the rear wall with the face plate 18 remaining outside the hole 42 and abutting the rear wall to hold the housing in place against the door when the rear portion of the lock cylinder is secured to the door in a conventional manner well known in the art.

The housing is then further fastened to the door 10 by means of the fasteners 44, shown as screws, and having a threaded shank portion 46 and a head portion 48. The housing contains clearance noles 50, 52 for the fasteners with the clearance holes 50 in the front wall permitting both the shank and head portions of the fastener to pass therethrough, while the clearance holes 52 on the rear wall only permits passage of the shank, thus retaining the head portion. The fasteners are then received by the tapped holes 54 contained in the door to secure the housing and prevent rotation thereof. The screws 44 are tightened by a conventional screwdriver adapted to have its end pass through the holes 50 for engaging the heads 48.

Figure 2:
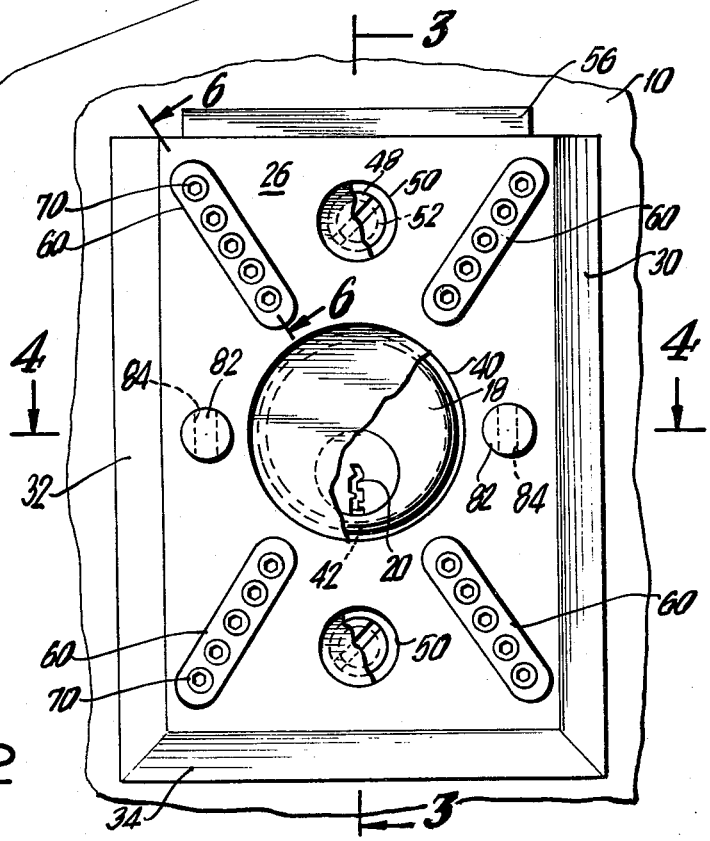
FIG. 2 is a front elevational view of the housing with the shield plate inserted therein.
Figure 3:
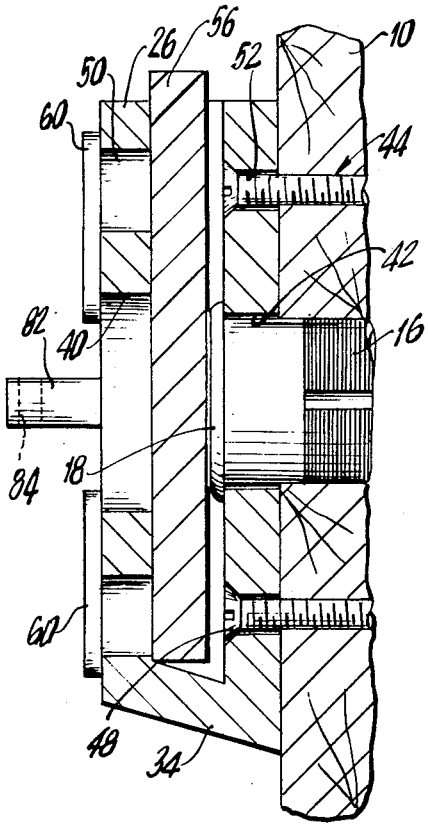
FIG. 3 is a side sectional view taken along line 3—3 of FIG. 2.
Figure 4:
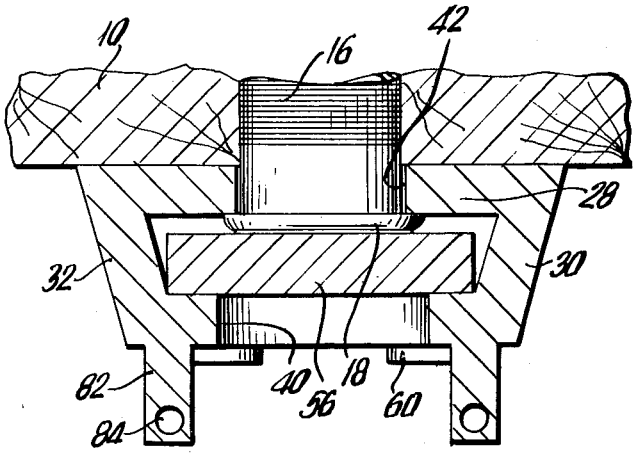
FIG. 4 is a top sectional view taken along line 4—4 of FIG. 2.

A shield plate 56 is adapted to slide in the slot 38 between a first and second position. In the first position, the shield plate blocks the clearance hole 42 in the rear wall and the face plate 18, thereby preventing access to the key hole 20 of the lock cylinder, as shown in FIGS. 2, 3 and 4. It is also noted that in the first position, the screwheads 48 are also blocked to prevent removal thereof. In its second position, the plate 56 can be removed from the slot, or at least raised sufficiently to clear a portion of the face plate 18 to provide access for a key 22 to be inserted into the key hole 20.

Figure 6:
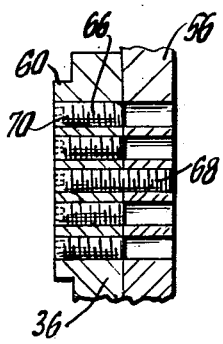
FIG. 6 is a sectional view taken along line 6—6 of FIG. 2, and specifically through the pins.

A plurality of threaded pins 58 are available for insertion through bosses 60 placed on the exterior front wall of the housing. The bosses can be formed or molded as one piece with the housing. Tapped holes 62 in the boss extend through the front wall of the housing and align with the tapped holes 64 in the shield plate, when in its first position. Some of the pins, such as 66 are short, while others of the pins, such as 68, are long. The short pins 66 are sized to extend only through the boss 60 and the front wall 26 of the housing. The longers pins 68 are sized to extend through the boss end front wall into the shield plate, and engage the tapped hole therein to thereby retain the shield plate in its lowered first position, thus preventing access with the lock. Such arrangement can be seen in FIG. 6.

The pins are shown to include a head portion 70 which contains receiving means such as a slot or an allenhead, etc. The heads are substantially identical so that when inserted, the length of the shank of the pin cannot be detected, as is evident from FIG. 2. The pins are positioned in an array, shown by way of example in an "X" configuration, whereby a plurality of pins are presented which appear uniform and substantially similar. However, some of the pins will be of the longer type 68 which engage the shield plate, while the remainder of the pins will be of the shorter type 66 which are only positioned within the front wall of the housing.

A tool, shown generally at 72, is in the form of a key. The tool 72 includes a ring 74 for holding the key, a shaft 76, and a pilot portion 78 whose end 80 includes means mating with the pin heads 70 for rotating the pins to insert and remove them from the tapped holes in the housing and shield plate.

Figure 7:
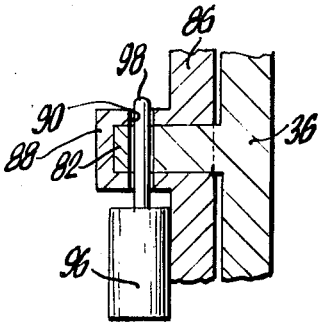
FIG. 7 is a side sectional view taken along line 7—7 of FIG. 5, and specifically through the post and locking device between the cover plate and the housing.

Outwardly extending from the face of the housing front wall are two posts 82 which contain therein transverse bores or openings 84. A cover plate 86 is provided and includes cylindrical post covers 88 for receiving the posts 82 therein. Bores or openings 90 in the post covers align with the bores 84 of the posts, as shown in FIG. 7. Recesses 92 are formed in the back side of the cover plate 86 by providing associated raised pads 94 on the front side to maintain the thickness thereof. The recesses 92 receive the bosses 60 on the housing.

Figure 5:
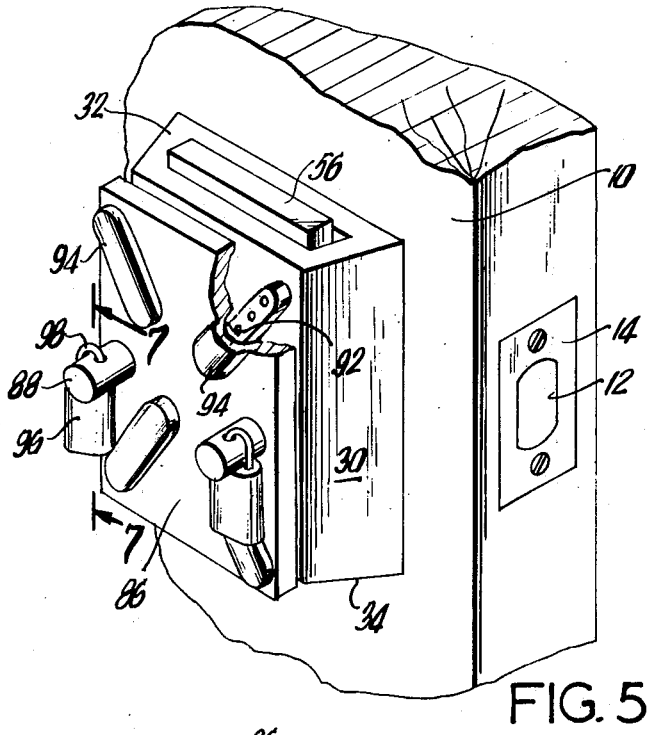
FIG. 5 is a perspective view of the assembled lock shielding assembly, showing the housing, shield plate and cover plate mounted at a door.

The cover plate 86 can therefore snugly fit against the front of the housing with the posts securely fitting into the post receivers and the bosses 60 positioned within the recesses 92. Conventional padlocks 96 can be utilized to lock the cover plate 86 on the front of the housing by passing the hasp portion 98 of each padlock 96 through the aligned bores 90, 84, thus preventing removal of the cover plate from the housing, as shown in FIG. 5. Keys 100 are utilized to open the padlocks 96.

To assemble and utilize the lock shielding apparatus, the housing 24 is aligned with the aperture 102 in the door which may be the door of a house, an automobile and the like. The cylinder 16 is then passed through the larger clearance hole 40 and inserted into the hole 102 in the door with the face plate 18 abutting the rear wall 28 of the housing. The cylinder lock is then secured to the door, in a conventional manner by threaded engagement therebetween, so that the housing is positioned relative to the door. The fasteners 44 are inserted through the clearance hole 50 with the threaded shank portion passing into the clearance hole 52, and are threaded into the tapped hole 54 securing the housing to the door.

The shield plate 56 is then slid into the slot 38 and the pins 58 are inserted into their aligned holes with the longer pins 68 engaging the shield plate 56 to securely retain it in its lower position preventing access to the lock cylinder. The cover plate 86 is then placed over the housing, and the padlocks 96 are inserted in the apertures 84, 90 to lock the cover plate onto the housing.

An unauthorized user approaching the locked door would thereby find it more difficult, inconvenient and extremely time consuming to break into the lock shielding assembly to reach the lock. The first impediment would be the cover plate. Even assuming that he could break open the pad locks and remove the cover plate, he would then find a plurality of identical looking pins holding the shield plate in position. Not knowing which of the pins actually engage the shield plate, it would be necessary for him to remove each and almost every one of the pins in order to free the shield plate. This is a most time consuming task which would in most cases prevent the thief from attempting it.

Furthermore, he would not be able to forceably remove the shield plate, since there would be an insuffient portion of the shield plate extending upward for him to grab. He also could not bang off the entire housing since the sides are angled so as to not provide a flat surface on which to bang. Should be try to pry the housing off the door, or should he succeed in bending the housing by continuous banging, since the lock is partially inserted into the housing, he would bend or completely break off the lock cylinder which would undoubtedly prevent the lock from being picked in a normal manner, and would also prevent the unlocking of the latch.

While numerous levels of security have been included in the complete lock shielding apparatus described, it is understood that any portion thereof can be utilized independently of the other part. For example, the shield plate could be utilized with the housing without the need of the additional cover plate and still provide a level of security. Additionally, the cover plate could be used directly over the housing without the shield plate being inserted, where the lock cylinder still would be inaccessible.

It should additionally be noted that the only one who knows the location of the longer pins is the authorized user who had inserted them. Since the external appearance of the pins are identical, it is possible for the authorized user to change the locations of the longer pins and continuously interchange their position after each locking, in a manner similar to changing the number combination of a lock. This provides a further measure of security for preventing others from knowing the position selected for the longer pins. P There has been disclosed heretofore the best embodiment of the invention presently contemplated. However, it is to be understood that various changes and modifications may be made thereto without departing from the spirit of the invention.

What is claimed is:

1. A lock-shielding assembly for preventing unauthorized access to a lock comprising:

a housing adapted to be fixedly superimposed over a front face of the lock, said housing having a front wall spaced from the lock face and a slot between said front wall and the lock face, a cooperating opening in said front wall providing access to the lock face;

a shield plate slidably disposed in said slot and movable between said front wall and the lock face from a first position closing said opening and covering the lock face to prevent access thereto through said opening to a second position displaced from said first position to permit access to the lock face through said opening; and a plurality of threaded pins extending into said front wall, selectable ones of said pins extending through said front wall and into threaded engagement with said shield plate to thereby retain said shield plate in said first position.

2. A lock-shielding assembly as claimed in claim 1, wherein each of said pins comprise a head portion and a threaded shank portion, all of the head portions being substantially identical, and wherein the shanks of said selectable ones of said pins are longer than the shanks of the other pins, whereby when in place, all of the pins externally appear substantially identical.

3. A lock-shielding assembly as claimed in claim 1, wherein said cooperating opening comprises a clearance hole in said front wall for passing therethrough both the lock cylinder and a lock face plate, and an aligned clearance hole in a rear wall of said housing for only passing the lock cylinder, whereby the lock face plate is positioned in said slot against said rear wall.

4. A lock-shielding assembly as claimed in claim 1 and further comprising at least one fastening means having a head and shank portion, said front wall including at least one clearance hole for passing therethrough the head of the fastening means, and a rear portion of said housing including an aligned clearance hole for passing the shank portion of the fastening means and restricting passage of the head.

5. A lock-shielding assembly as claimed in claim 1, wherein said front wall is connected at its perimeter by angled bottom and side walls, and wherein said slot extends through the top section of said housing.

6. A lock-shielding assembly as claimed in claim 1, wherein said pins are positioned in an array, and further comprising a pattern of bosses on an exterior of said front wall to accommodate said array of pins.

7. A lock-shielding assembly as claimed in claim 1, wherein said pins include a threaded end, and wherein said front wall and said shield plate include aligned tapped holes for accommodating the threaded end of said pins.

8. A lock-shielding assembly as claimed in claim 1, wherein said pins include heads having tool receiving means, and further comprising tool means having a pilot portion for engaging said tool receiving means to thereby insert and remove said pins.

9. A lock-shielding assembly as claimed in claim 1 and further comprising cover means removably superimposed and lockable on said housing to prevent access to said pins.

10. A lock-shielding assembly as claimed in claim 9, wherein said front wall includes post means extending therefrom, and wherein said cover means includes a cover plate, post cover means on said cover plate for mating with said post means, said post means and post cover means having aligned bores therein, and locking means extending through said aligned bores for preventing unauthorized removal of said cover plate from said housing.

11. A lock-shielding assembly for preventing unauthorized access to a lock comprising:

a housing adapted to be fixedly superimposed over a front face of the lock;

opening means in a portion of said housing permitting access to the lock face;

post means on said housing;

a cover plate removably superimposed on said housing to close said opening means for preventing access to the lock face through said opening means;

post cover means on said cover plate for matingly receiving said post means therein to enclose said post means; said post means and post cover means having aligned bores extending therethrough;

locking means extending through said aligned bores for preventing unauthorized removal of said cover plate from said housing;

said housing including a front wall and a slot adjacent to said front wall;

said opening means including an opening in said front wall communicating with said slot;

a shield plate slidably mounted in said slot for movement between a first portion closing said opening and covering the lock face to prevent access thereto through said opening and a second position displaced from said first position to permit access to the lock face through said opening; and a plurality of pins extending into said front wall, selectable ones of said pins extending through said front wall and into engagement with said shield plate to thereby retain said shield plate in said first position, said cover plate being disposable over said pins for preventing access to said pins when superimposed on said housing.

12. A lock-shielding assembly as claimed in claim 11, wherein each of said pins comprise a head portion and a threaded shank portion, all of said head portions being substantially identical, and wherein the shanks of said selectable ones of said pins are longer than the shanks of the other pins, whereby when in place, all the pins externally appear substantially identical.

13. A lock-shielding assembly as claimed in claim 11 and further comprising bosses on an exterior of said front wall to accommodate said pins, and wherein said cover plate includes recesses on one side thereof for receiving said bosses, and raised pads on the other side of said cover plate corresponding to the recesses.

14. A lock-shielding assembly as claimed in claim 11, wherein includes an opening in a front said post means includes a pair of posts extending outwardly from said front wall with one of said posts being disposed on each side of said opening, said post cover means including a pair of hollow members for covering said pair of posts.

* * * * *